United States Patent [19]

Houle

[11] Patent Number: 4,744,159

[45] Date of Patent: May 17, 1988

[54] READILY DETACHABLE MOUNTING FOR A WING PLOW

[75] Inventor: Bertrand Houle, Drummondville, Canada

[73] Assignee: Tenco Machinery Ltd., Valérien, Canada

[21] Appl. No.: 903,193

[22] Filed: Sep. 3, 1986

Related U.S. Application Data

[63] Continuation-in-part of Ser. No. 721,660, Apr. 10, 1985, abandoned.

[51] Int. Cl.[4] ..... E01H 5/06

[52] U.S. Cl. ..... 37/231; 37/236; 37/281

[58] Field of Search ..... 37/231, 232, 281, 236

[56] References Cited

U.S. PATENT DOCUMENTS

| | | | |
|---|---|---|---|
| 2,643,470 | 6/1953 | Kaeser | 37/232 X |
| 3,845,577 | 11/1974 | Naymik | 37/231 |
| 4,236,329 | 12/1980 | Hetrick | 37/231 |
| 4,357,766 | 11/1982 | Croteau et al. | 37/281 |

FOREIGN PATENT DOCUMENTS

| | | | |
|---|---|---|---|
| 1212540 | 10/1986 | Canada | 37/281 |

*Primary Examiner*—Clifford D. Crowder
*Attorney, Agent, or Firm*—Samuel Meerkreebs

[57] ABSTRACT

The mechanism comprises in combination an upstanding frame mounted to the front of the chassis of a land vehicle and adapted to mount a front plow assembly, and a side frame mounted to the side chassis of the land vehicle for mounting a side wing plow. Both the front and side frames include a sub-frame pivotally mounted to the lower portion of the upstanding frame, hydraulic means for moving the sub-frame in an arc between a retracted and an extended position. The sub-frame has a free end mounting an engagement member remote from the pivot axis and adapted to engage a sub-frame on a plow assembly frame. The sub-frame on the plow assembly includes a hook member open downwardly and adapted to receive the engagement member of the free end of the first sub-frame and locking means associated with the first and second sub-frames for locking the first and second sub-frames together when the engagement member is engaged within the hook member and the pivoted sub-frame is in a retracted position.

5 Claims, 5 Drawing Sheets

READILY DETACHABLE MOUNTING FOR A WING PLOW

CROSS-REFERENCE TO RELATED APPLICATION

This application is a continuation-in-part application of copending application Ser. No. 721,660, filed Apr. 10, 1985, now abandoned.

BACKGROUND OF THE INVENTION

1. Field of the Invention

The present invention relates to a mechanism for removably securing a snowplow system to a land vehicle.

2. Description of the Prior Art

When a road vehicle is used for snow removal and wherein a front plow and a side wing plow combination is to be secured to the vehicle, it is necessary to modify the vehicle by, for instance, permanently installing a column to the side of the vehicle chassis behind the passenger cabin. The side wing plow, for instance, is connected to this column by various types of linkages, either cable or hydraulic linkages, and it may be used to support the outer end of the wing plow in a position of use over the ground or in a storage position against the vehicle. Reference is made to U.S. Pat. No. 4,357,766, issued Nov. 9, 1982, Croteau et al, showing a hydraulic linkage. The same is true for the front plow system wherein a usually heavy frame is mounted to the chassis which either must be removed by hand or is left on the vehicle.

A disadvantage of permanently securing such frames or posts to such road vehicles is that they add considerable weight to the vehicle and, therefore, when the vehicle is not used for snowplowing, the payload which it can carry is reduced due to the extra load that it must permanently carry. Also, this added weight reduces the fuel efficiency of the vehicle. Usually, one of these vertical columns and its attachment linkage can weigh in the vicinity of 600 pounds. Also, if a front column is also permanently secured to the vehicle, it can result in an extra total weight of approximately half a ton that the vehicle must carry. A further disadvantage of permanently securing such columns to a vehicle is that it often obstructs the view of the conductor and is a safety hazard. Also, the column can be damaged when the vehicle is used for other work, such as carrying loads of earth or stones, etc.

U.S. Pat. No. 4,236,329 illustrates a front end plow mounting device using a hydraulically operated device for mounting the front plow. A folding articulated bracket is adapted to engage a frame on which the front plow is mounted. Tube members on the bracket engage opposed pairs of open slots in the frame. This patent is an improvement over existing systems in that it reduces considerably the weight carried by the vehicle when the plow assembly is disengaged from the vehicle.

SUMMARY OF THE INVENTION

An aim of the present invention is to provide a mounting mechanism for detachably mounting a front end plow to a vehicle which requires the minimum manual handling in attaching the front plow and reduces to a minimum the structural components remaining on the vehicle after the front plow has been removed.

Another feature of the present invention is to provide a mechanism for detachably securing a rear support of a side wing plow to the side of a vehicle chassis to substantially overcome all of the above-mentioned disadvantages of the prior art.

Another feature of the present invention is to provide a mechanism for detachably securing a rear support of a wing plow to a land vehicle by securing to the vehicle a retaining frame capable of grasping and positioning the support and securing same in position on a vehicle chassis and fixedly attaching the support to the chassis.

A construction in accordance with the present invention comprises, in combination, a mechanism mounted to the chassis of a land vehicle for detachably mounting a plow assembly to the vehicle, wherein the mechanism comprises a first upstanding frame mounted to the chassis and including a lower and upper portion and elongated guide means provided thereon. A first sub-frame is pivotally mounted to the lower portion of the first frame, and hydraulic means are provided for moving the first sub-frame in an arc about a pivot axis at the lower portion of the first frame between an extended position and a retracted position. The elongated guide means engages the first sub-frame when the first sub-frame is in a retracted position. The first sub-frame has a free end mounting an engagement member remote from the pivot axis, and there are flared aligning members extending away from the free end of the first sub-frame. The plow assembly includes a second frame means mounting a plow blade, and the second frame means includes a second sub-frame including an upper portion and a lower portion, with the upper portion in the form of a downwardly open hook member adapted to receive the engagement member of the free end of the first frame. Locking means are associated with the lower portions of the first and second sub-frames for locking the first and second sub-frames together when the engagement member on the first sub-frame is engaged within the hook member and the first sub-frame is in a retracted position.

In one embodiment, the upstanding frame is a front plow mounting mechanism having a lower portion to which a pair of spaced-apart parallel side members of the first sub-frame are pivotally mounted. Each side member of the first sub-frame includes a pair of spaced-apart parallel plate members, and the upstanding frame includes elongated guide means in the form of plate members adapted to be intercalated between the plate members of the side members of the first sub-frame. The sub-frame is pivoted to the upstanding frame by means of pivot pins passing through the plates forming the side member of the sub-frame and through the intercalated plate forming a guide member of the upstanding frame. An engagement member is provided at the free end of each side member of the sub-frame, and outwardly diverging flange members extend from the outermost plate of the side members from the free ends thereof. The second sub-frame on the plow assembly includes a pair of spaced-apart elongated members, including downwardly open hook members corresponding to the engagement members on the first sub-frame. The lower portion of the spaced-apart members on the second sub-frame includes apertures through which locking pins can be passed and engaging the second sub-frame to the first sub-frame and the guide members on the upstanding frame in respective apertures therein when the first sub-frame is in a retracted position.

In another embodiment, there is, in combination, a side wing plow detachable rear second sub-frame and an upstanding frame for detachably securing the rear second sub-frame and the side wing plow to the land vehicle. The support upstanding frame is secured at a predetermined location to the side of the chassis of the land vehicle. A coupling mechanism is provided for connecting and disconnecting the rear support with the retaining frame. The mechanism has a pivotally displaceable first sub-frame provided with a free end with an engagement member for detachable engagement with a hooking member secured to the second sub-frame to engage and displace it to a retracted position with the upstanding frame and a locking pin and aperture arrangement for locking the first and second sub-frame.

The present invention is especially suitable to be used with a hydraulic linkage of the type described in U.S. Pat. No. 4,357,766. For instance, the support could be in the form of a column, post or tower, on which a bracket or carriage is adapted to slide in a vertical plane. This is sometimes called a shelving tower, and a carriage carrying the side plow linkages can be raised to a predetermined level above the ground such that the side plow can be extended in order to displace the top of a snow bank. The support can also be in the form of a bracket to which the links are directly connected.

BRIEF DESCRIPTION OF THE DRAWINGS

A preferred embodiment of the present invention will now be described with reference to the example thereof as illustrated in the accompanying drawings, in which.

DESCRIPTION OF THE PREFERRED EMBODIMENTS

Figure 1:
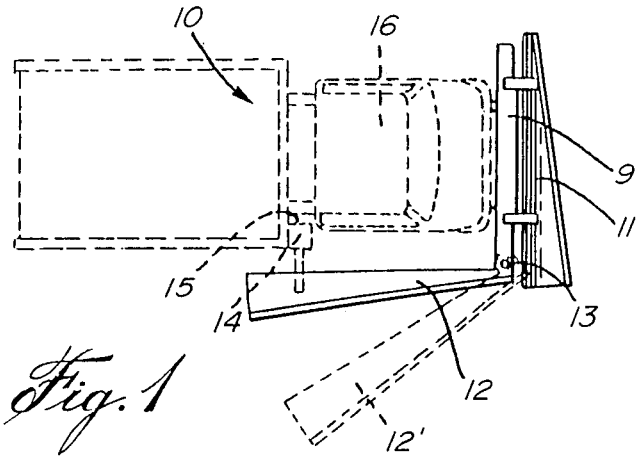
FIG. 1 is a schematic top view of a land vehicle equipped with a front and side wing plow.

Referring now to the drawings and briefly to FIG. 1, there is shown a truck 10 having secured adjacent its front end a front plow 11 and a side wing plow 12. The side wing plow 12 is supported between a front support tower 13 which is secured to the front plow support frame assembly 9, and a rear support tower 14 which is secured to the side of the chassis 15 of the truck 10 behind the passenger cabin 16. In order to attach the front plow and side wing plow to the truck 10, it is necessary to position the truck 10 in substantially the exact position as when the plow assembly was disconnected and to reconnect them with the front frame 9 being connected firstly to accurately position the side wing plow 12 for re-engagement. The present invention is concerned with a detachable mechanism whereby the front plow frame assembly 9 and rear support tower 14 can be detached from the truck 10 together with the side wing plow 12.

Figure 2:
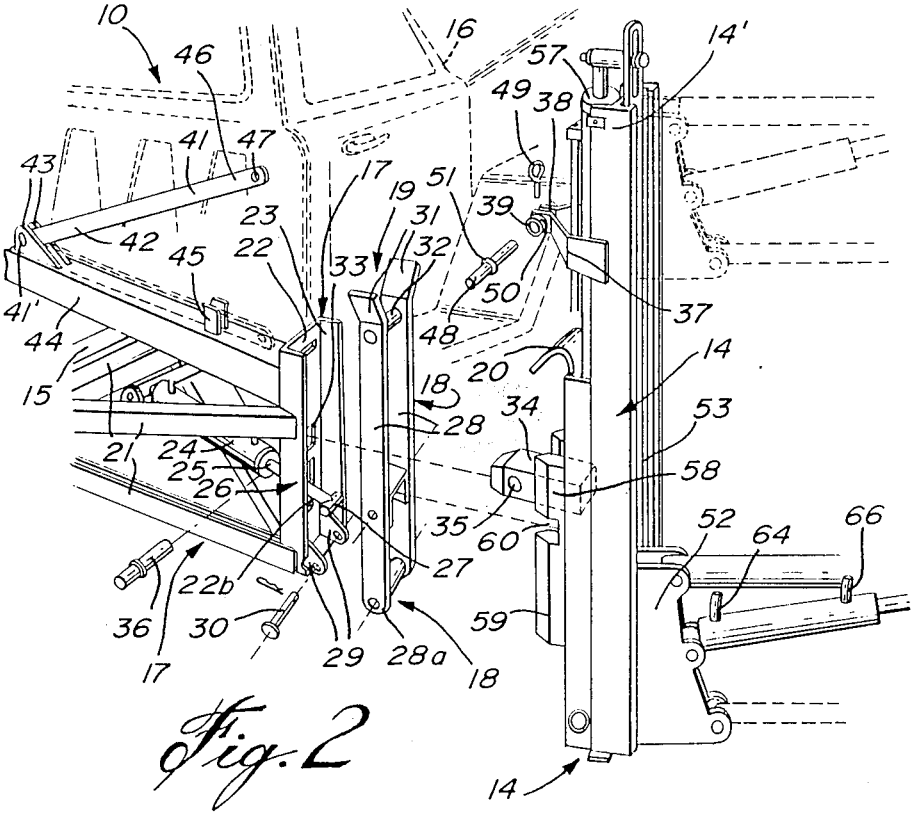
FIG. 2 is an exploded perspective view of the detachable rear support tower and the tower retaining frame showing its attachment to a land vehicle.
Figure 3:
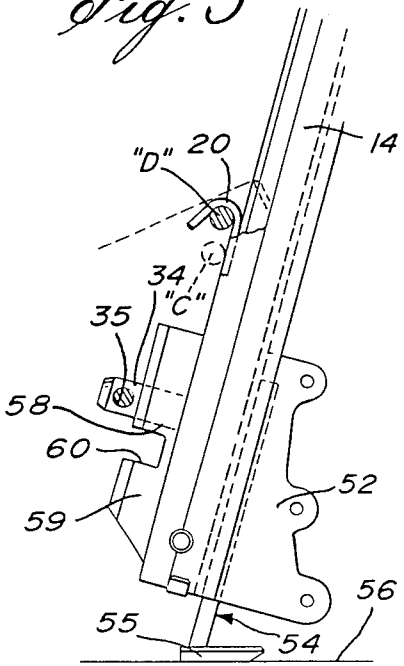
FIG. 3 is a fragmentary side view showing the rear support tower in its storage position.
Figure 4:
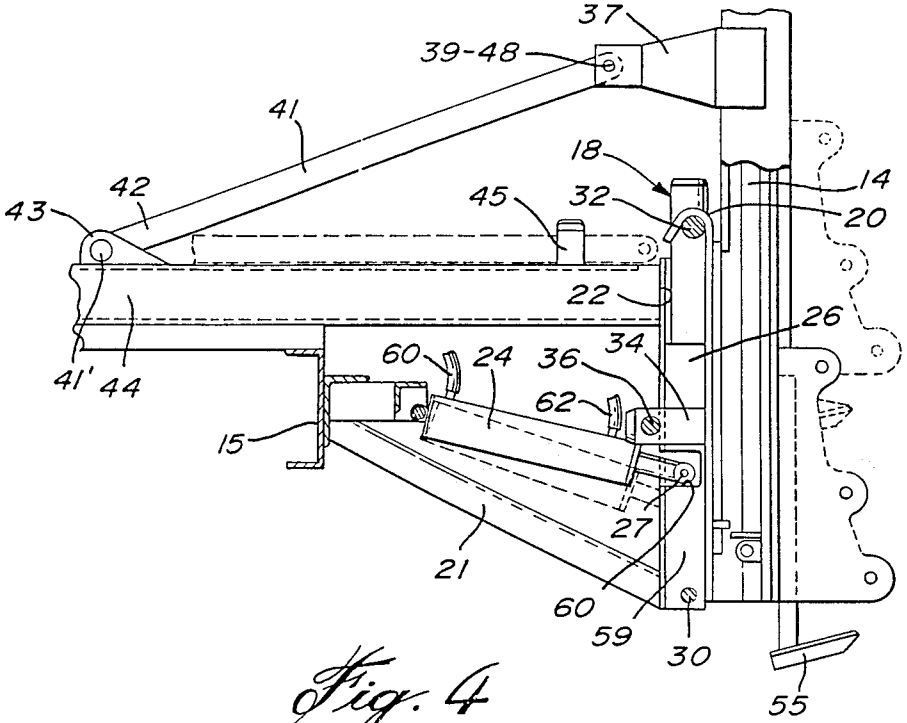
FIG. 4 is a fragmentary side elevation, similar to FIG. 3, showing the rear support tower in a vehicle mounted position.

Referring now to FIGS. 2 and 3, it can be seen that the detachable mechanism of the embodiment illustrated therein is comprised by the combination of a side wing plow detachable rear support tower 14 and a tower retaining frame 17. The upstanding frame or tower retaining frame 17 is permanently secured to the chassis 15 of the vehicle 10 behind the passenger cabin 16 and at a predetermined location depending on the distance between the front support tower 13 and the rear support tower 14. A coupling mechanism is provided for connecting and disconnecting the rear support tower 14 with the tower retaining frame 17, and it comprises a pivotally displaceable gripping arm 18 provided with an engagement member 19 for detachable engagement with a hook member 20 which is secured to the tower 14 to engage the tower from its detached storage or non-use position, as shown in FIG. 3, and displace it to a secured position, as shown in FIG. 4, with the tower retaining frame 17. When in the position shown in FIG. 4, the tower 14 is then locked with the tower retaining frame 17.

The tower retaining frame 17 is provided with a vertical channel member 26 secured to a frame member 21 and defines a flat rear wall 22 and opposed parallel side walls 23. A cylinder 24 is secured to the frame member 21 and has a piston rod 25 which extends through a vertical slot **22*a* provided in the flat rear wall 22 of the channel member 26. A piston rod end 27 is pivotally secured between two straight flat bars 28 which are secured in parallel spaced-apart relationship and constitutes the pivoting sub-frame in the form of arm 18. The lower end 28*a* of the arm 18 is pivotally mounted to a stationary pivot connection provided by a pair of wing flanges 29 and a pivot pin 30 extending therethrough and secured in the lower end of the vertical channel member 26**.

The two straight flat bars 28 extend beyond the end 19 of the arm 18 in the form of a diverging outer end portion 31 defining a guide throat positioned above an engaging member in the form of a transverse pin 32 which is secured across the flat bars 28 and is adapted to engage into the hooking member 20 of the rear support tower 14.

The hooking member 20 is constituted by a hook-shaped plate welded or otherwise secured in the rear face of the rear support tower 14.

The rear flat wall 22 of the vertical channel member 26 is also provided with a through-hole 33 to receive therethrough a guide member lock bolt 34 also permanently secured to the rear face of the rear support tower 14. The lock bolt 34 has a transverse bore 35, and when the rear support tower 14 is engaged in its position of use (FIG. 4) with the retaining frame 17, a lock pin 36 is removably engaged in the bore 35 behind the flat wall 22 and abuts this wall across the through hole 33 thereby locking the rear support tower 14 and the gripping arm 18 to the vertical channel member 26.

In the embodiment of FIGS. 1 to 4, an upper locking member is also provided and is comprised by a pair of projecting side arms 37 which are welded to the side walls 14' of the rear support tower 14 and bent inwardly to define a forward securing slot 38 in a free end portion thereof. A through bore 39 is provided in each of the arms 37 across the slot 38 and has a guide sleeve 50 welded thereabout. A link arm 41 is pivotally connected to an end 42 between a pair of wing flanges 43 secured to the top wall of a frame member 44 which is welded to the chassis 15. A retaining clamp 45 is also secured to the frame member 44 to frictionally retain the arm 41 therein when the arm 41 is not connected to the upper locking member. The free end 46 of the arm 41 is provided with a through bore 47 therein, and the length of the projecting side arms 37 is calculated whereby the through bore 47 will align itself with the through bores 39 in the arms 37 when the rear support tower lock bolt 34 is attached to the channel member 20. A lock pin 48 is then inserted through the bores 39 and the bore 47 and retained in place by an attachment pin 49 which extends through a pin hole in one of the guide sleeves 50 and the pin hole 51 in the lock pin 48.

The rear support tower 14 illustrated in the drawings is provided with a sliding carriage 52 which is displaceable in a vertical track 53 moving the wing plow between a "shelving" position in the upper position and a lower position for plowing close to the ground. A foot 54 is provided with a bottom skate plate 55 supporting the rear support tower 14 and its side plow 12 at a desired position on a ground surface 56. The skate plate 55 prevents damage to the ground surface when displaced thereover. The sliding carriage 52 is moved along the track 53 by a lifting hydraulic cylinder and piston 57. This piston and the slide carriage 52 do not form part of the present invention but are briefly described for clarity of the drawings.

The locking bolt 34 is also held secured between a pair of guide plates 58. Plates 58 have downward extensions 59 between which the piston rod end 27 is connected, as shown in FIG. 3.

The guide plates 58 and 59 act to stabilize the tower 14 within the channel 26 of the retaining frame 17. The flat bars 28 extend vertically within the space between the spaced-apart guide members 58 and 59 such that these guide members 58 and 59 are intercalated between the flanges 23 forming the channel 26 and the flat bars 28 of the pivoting arm 18. Thus, when the pivoting arm 18 is retracted within the channel 26 with the tower 14 engaged thereon, and the locking pins 36 lock the bolt 34 within the structure, the assembled structure is rigid and stable.

Figure 5:
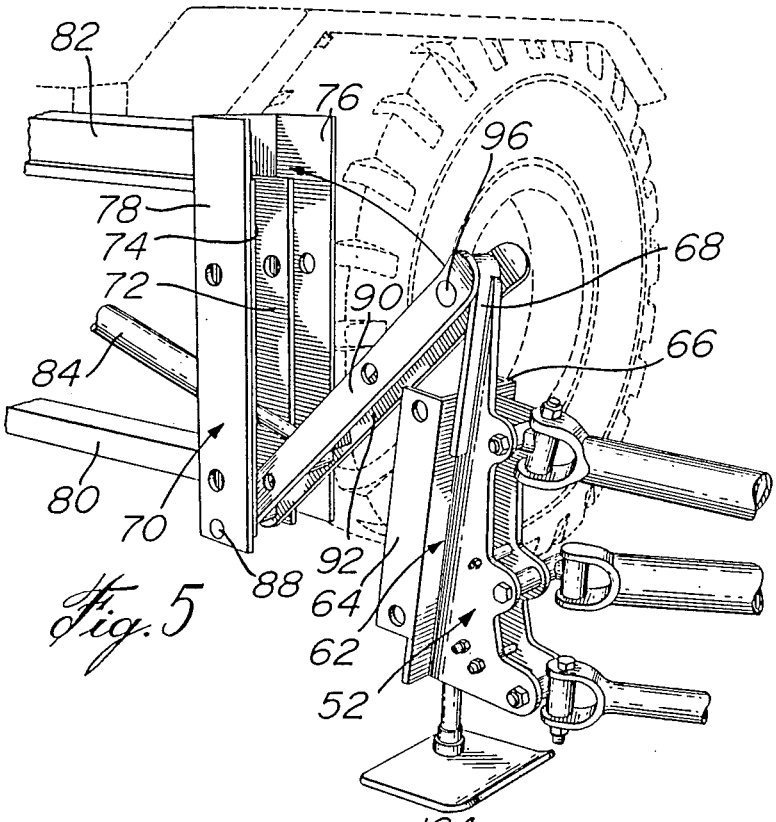
FIG. 5 is a perspective view of another embodiment of a mechanism for detachably mounting the side wing plow.
Figure 7:
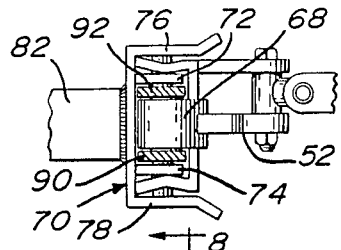
FIG. 7 is a fragmentary top plan view, partly in cross-section, taken along line 7—7 of FIG. 6.
Figure 6:
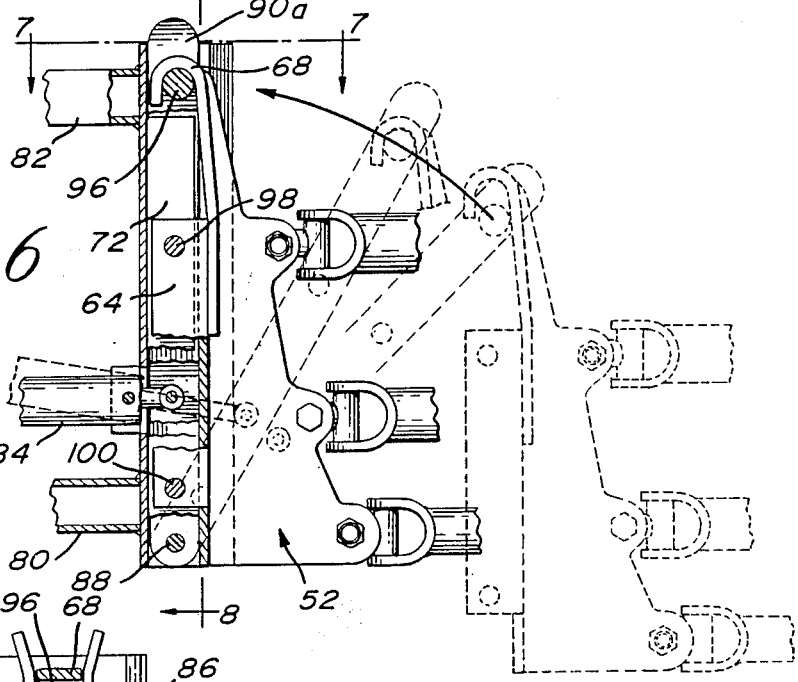
FIG. 6 is a fragmentary side elevation, partly in cross-section, showing in solid lines the mechanism in its retracted position, and in dotted lines, the mechanism in its extended position.
Figure 8:
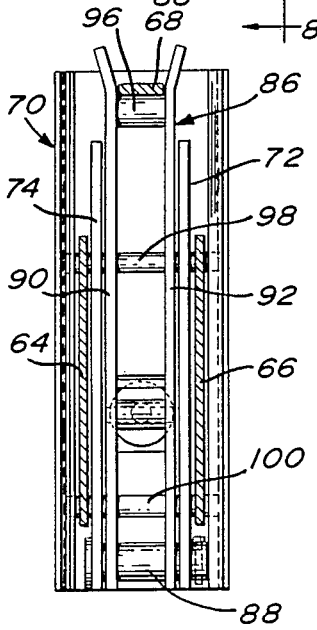
FIG. 8 is a vertical cross-section, taken along line 8—8 of FIG. 6.

Another embodiment of a mounting mechanism for the side wing plow is illustrated in FIG. 5. In this case, there is no tower 14, but the carriage 52 is fixed to a sub-frame 62 which includes flanges 64 and 66 as well as an upstanding hook member 68 having a downwardly open portion. The retaining frame 70 is of similar structure to that described in relation to FIGS. 1 and 2 with the exception that it also includes elongated guide plates 72 and 74 parallel to but spaced from the flanges 76 and 78 of the channel formed by the retaining frame 70. The upright frame or retaining frame 70 is mounted on frame members 80 and 82 which are directly fixed to the chassis of the vehicle. A piston and cylinder arrangement 84 extends between the frame member 82 and the pivoting sub-frame or arm 86. The arm 86 is pivoted at the lower end of the upstanding frame 70 by means of pivot pin 88 extending between the flanges 78 and 76. The arm 86, which includes a pair of spaced-apart flat bars 90 and 92, is constructed such that it is just barely received within the pair of guide members 72 and 74 when it is retracted within the upstanding frame 70 so as to stabilize the arm 86 during use. The flanges 64 and 66 of the sub-frame 62 are adapted to be intercalated between the flanges 76, 78 and 72, 74 respectively when the assembly is retracted. As can be seen in FIG. 7, the flanges 64 and 66 may be bent in order to resiliently engage the guide plates 72 and 74 and flanges 76 and 78 when the flanges 64 and 66 are intercalated therebetween.

Figure 9:
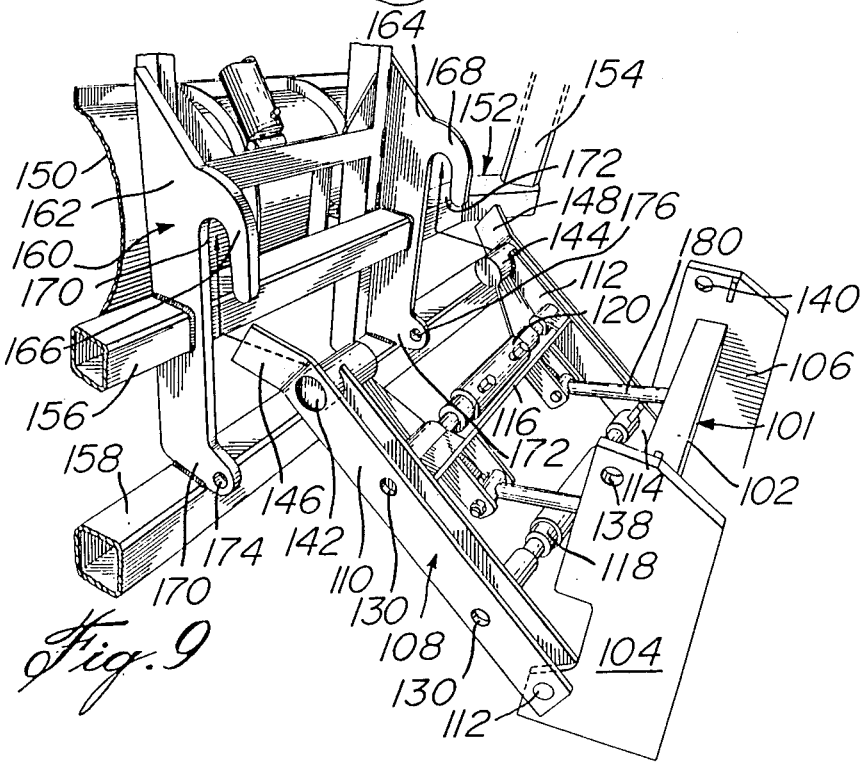
FIG. 9 is a perspective view showing an embodiment of a front plow assembly and the mounting mechanism therefor in a disengaged position.
Figure 10:
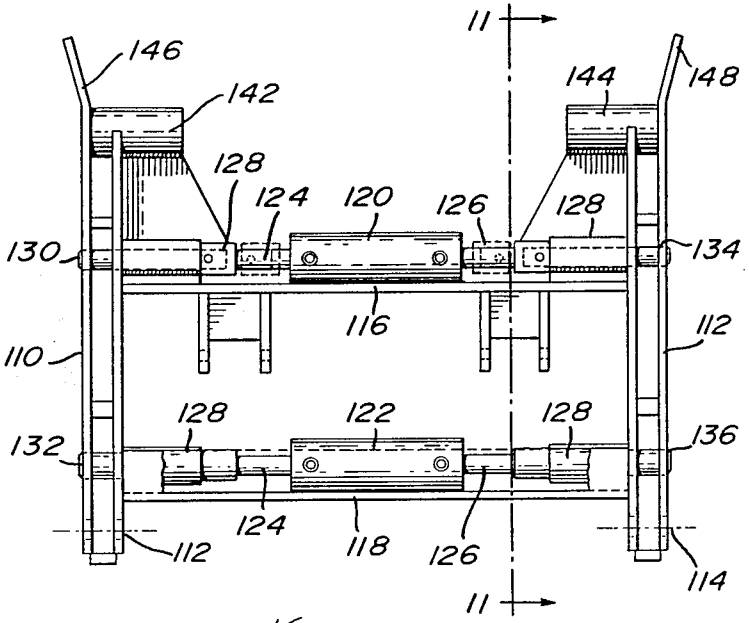
FIG. 10 is a rear elevation of a detail of the mounting frame of the mechanism.
Figure 11:
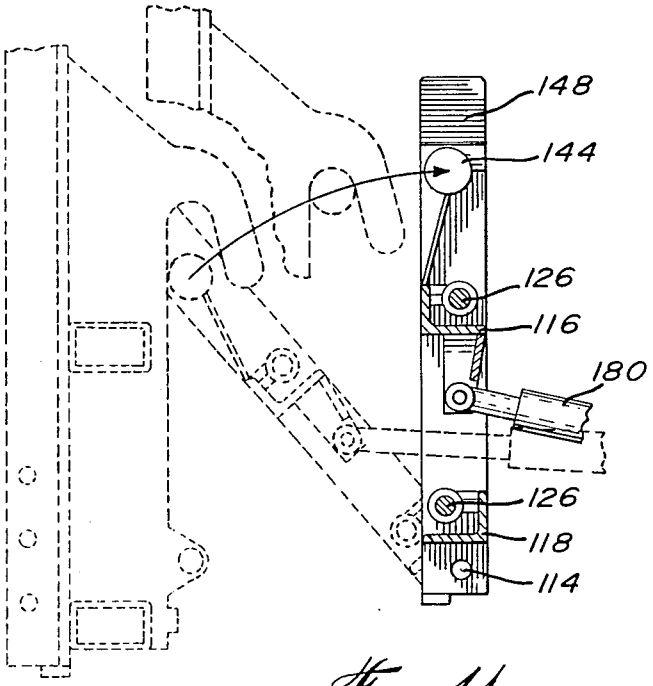
FIG. 11 is a vertical cross-section, taken along line 11—11 of FIG. 10.

Referring now to FIGS. 9 through 11, there is shown an upstanding frame fixed to the front of the chassis and including a horizontal frame member 102 connected to guide plate members 104 and 106. A sub-frame 108, including side frame members 110 and 112, is pivoted to the bottom of the upstanding frame 101. Each side frame member is made up of two parallel elongated plates spaced apart and saddling the respective guide plate members 104 and 106 and being pivoted thereto by means of pins 112 and 114 respectively passing through apertures in the bottoms of the guide plates 104 and 106. A pair of intermediate frame members 116 and 118 extend between the side frame members 110 and 112. These frame members 116 and 118 mount a pair of cylinders 120 and 122 which in turn have pistons 124 and 126 extending from each end thereof in the form of locking pins. These locking pins slide in bearing members 128, mounted at each end of the respective intermediate frame members 116 and 118, and are adapted to guide the piston members 124 and 126 to extend through apertures 130, 132, 134, and 136, respectively. Corresponding apertures are provided on the guide plates 104 and 106 and are identified, for instance, by the numerals 138 and 140. Engagement bolts 142 and 144 are provided at the free end of the side members 110 and 112. Diverging end members 146 and 148 are located on either side of the side frame members beyond the free ends thereof.

The front plow assembly includes a plow blade 150 mounted to a frame 152. At one end of the frame 152 is a column 154 to mount the front end of the side plow 12. The frame includes horizontal frame members 156 and 158 on which a sub-frame 160 is fixedly mounted. The sub-frame includes vertical plate members 162 and 164 each having a hook member 166 and 168 with a downwardly facing jaw 170 and 172. The bottom of each of the sub-frame plate members 162 and 164 are provided with feet 170 and 172, including apertures 174 and 176 respectively.

When it is required to mount the plow assembly on a vehicle 10, the vehicle is placed adjacent the plow assembly, and the sub-frames 90 and 108 are extended by means of the hydraulic arrangements 84 and 180 to a position whereby the engaging members 96, 142, and 144 can engage the hook members 68 and 166, 168 respectively.

In the case of the front plow, the hydraulic arrangements 180 are then retracted to retract the sub-assembly 108 thereby lifting the plow assembly by means of the hooks 166 and 168 until the feet 170 and 172 are intercalated between the plate members forming the side members 110 and 112 respectively. The cylinder arrangements 120 and 122 are then operated to extend the pistons 124 and 126 such that they simultaneously engage the holes 130 and 132 on side frame member 110 and 134 and 136 on side frame member 112. The holes 174 and 176 are aligned with holes 130 and 132 when the sub-assembly 108 is retracted, and thus the lower part of the sub-frame 160 is locked within the sub-frame 108 and the upstanding frame 101 as the pistons 124 and 126 extend through the apertures 130, 134, and 138 and 140 on the upstanding frame 101.

On the side upstanding frame member, the flanges 64 and 66 are intercalated between the flanges 78, plate 74, plate 72, and flange 76, as the sub-frame arm 86 is retracted. Pins 98 and 100 are manually placed through the aligned apertures, as shown in the drawings.

The side plow and front plow are then in the position to be operated.

The operation of the mechanism will now be described briefly with reference to FIGS. 3 and 4. The piston 24 is actuated to retract the piston rod, causing the gripping arm 18 to retract to its vertical position as shown at E in FIG. 3 with the opposed arms 28 located inside the side walls 23 of the vertical channel member 20. The locking pin 34 is then in position through the through bore 33 and is locked in that position by the locking pin 36. The pivotal arm 41 is then swung upwardly and connected in the slot 38 of the upper locking member, as previously described. Thus, it can be seen that the rear support tower 14 is solidly immovably retained by three connection, namely, (1) the locking bolt 34, (2) the hook plate 20 and bolt 32, and (3) the upper locking member comprised by the arms 37 and the pivotal arm 41. Thus, there are three spaced-apart connection points along the tower retaining frame 17, and a further connection point connected at end 42 of the pivotal arm 41. Further, the structural block 59 is tightly received between the opposed arms 28 of the gripping arm 18 preventing any lateral motion of the rear support tower.

A security feature has been provided by way of the fact that the hydraulic hoses 60 and 62 normally connected to the nipples 64 and 66 on cylinder 68 (part of the linkage for the side plow 12) are those used alternatively to operate the cylinder 24. Thus, the hoses 60 and 62 must be physically removed from the cylinder 68 and applied to the cylinder 24 before the detachment of the plow can be effected by way of operating the cylinder 24 and the arm 18.

It is within the ambit of the present invention to cover any obvious modifications of the example of the preferred embodiment described herein, provided such modifications fall within the scope of the broad claims appended hereto.

I claim:

1. In a land vehicle comprising a chassis and a mechanism mounted to the chassis for detachably mounting a plow assembly to the vehicle, wherein the mechanism comprises in combination a first upstanding frame mounted to said chassis, the first upstanding frame including a lower and upper portion and elongated guide means provided on the first frame, a first sub-frame pivotally mounted to the lower portion of the first upstanding frame, hydraulic means for moving the first sub-frame in an arc about a pivot axis at said lower portion of the first upstanding frame between an extended position and a retracted position, said elongated guide means engaging said first sub-frame when said first sub-frame is in a retracted position, said first sub-frame having a free end mounting an engagement member remote from the pivot axis and flared aligning members extending away from said free end of said first sub-frame, said plow assembly including second frame means mounting a plow blade and said second frame means including a second sub-frame including an upper portion and a lower portion, with the upper portion in the form of at least a downwardly open hook member adapted to receive the engagement member on the free end of the first sub-frame and locking means associated with the lower portions of the first and second sub-frames for locking the first and second sub-frames together when the engagement member on the first sub-frame is engaged within the upper portion hook member of the second sub-frame and the first sub-frame is in a retracted position.

2. A mechanism as defined in claim 1, wherein the first and second sub-assemblies include plate members adapted to be intercalated when said first and second sub-assemblies are engaged and the locking members include corresponding apertures in the intercalated plates adapted to receive a locking pin therethrough.

3. A mechanism as defined in claim 1, wherein the first upstanding frame is in the form of a front frame adapted to receive a front plow assembly, and the first sub-frame includes a pair of spaced-apart parallel side members joined by cross members, the lower ends of the side members being pivotally mounted to the first upstanding frame in the lower portion thereof, each side member of the first sub-frame including a pair of spaced-apart parallel plate members, and the first upstanding member includes elongated guide means in the form of plate members adapted to be intercalated between the pairs of plate members forming the side members of the first sub-frame, the first sub-frame including pivot pins passing through the intercalated plates forming the respective side members of the first sub-frame and through the plate forming the guide member of the first upstanding frame, an engagement member provided at the free end of each side member of the first sub-frame, the second sub-frame on the plow assembly including a pair of spaced-apart elongated members adapted to coincide with the side members of the first sub-frame, each elongated member including a downwardly open hook member corresponding to the engagement members on the first sub-frame, the lower portion of the spaced-apart members on the second sub-frame including apertures through which locking pins can be passed to engage the second sub-frame to the first sub-frame in respective apertures therein when the first sub-frame is in a retracted position.

4. A mechanism as defined in claim 1, wherein the upstanding frame is mounted to the side of the chassis of the land vehicle for mounting a side wing plow, the first sub-frame including an arm pivoted to the lower portion of the first upstanding frame and including a cylindrical engagement member at the other end of the arm, the second sub-frame being in the form of an upstanding column having on one face thereof a hook member having the opening of the hook extending in a downward manner and adapted to receive the engagement member on the first sub-frame and the guide members including pairs of guide plates mounted on the upstanding column adapted to be intercalated with the arm of the first sub-frame and the upstanding member, the first upstanding member being in the form of a channel and the arm of the first sub-frame being in the form of a pair of parallel spaced-apart plates adapted to be intercalated with the guide plates on the second sub-frame, the column of the second sub-frame including a locking projection adapted to pass through an aperture in the first upstanding frame and locking pin means adapted to engage the locking projection to lock the column to the first upstanding frame when the first sub-frame is in its retracted position, and the column including track means to allow a carriage to move along a vertical axis, said carriage carrying support members for the side wing plow.

5. A mechanism as defined in claim 1, wherein the second sub-frame includes a mounting member for mounting support means for supporting the side wing plow, and the second sub-frame including a hook member having a downwardly extending opening adapted to receive the engagement member on the first sub-frame, the first sub-frame being in the form of an arm pivoted at the lower portion of the first upstanding frame, the arm including a pair of spaced-apart plates and the first upstanding frame being in the form of a channel with the flanges of the channel parallel to the plates forming the arm and the second sub-frame including a pair of guide members in the form of flanges adapted to be intercalated with the flanges of the first upstanding frame, and a further pair of guide plates within the channel of the first upstanding frame and parallel to the flanges thereof to be intercalated with the flanges of the second sub-frame and the plates of the first sub-frame arm.

* * * * *